US005465139A

United States Patent [19]

Kimura et al.

[11] Patent Number: 5,465,139

[45] Date of Patent: Nov. 7, 1995

[54] DEVELOPER HAVING A TONER HOPPER DISPOSED COMPLETELY BELOW THE IMAGING DRUM

[75] Inventors: Noriyuki Kimura, Kawasaki; Minoru Suzuki, Yokohama, both of Japan

[73] Assignee: Ricoh Company, Ltd., Tokyo, Japan

[21] Appl. No.: 290,100

[22] Filed: Aug. 15, 1994

Related U.S. Application Data

[63] Continuation of Ser. No. 50,610, Apr. 22, 1993, abandoned.

[30] Foreign Application Priority Data

May 8, 1992 [JP] Japan ..... 4-116235

[51] Int. Cl.[6] ..... G03G 15/06

[52] U.S. Cl. ..... 355/260; 355/245; 355/259

[58] Field of Search ..... 355/245, 246, 355/260, 208, 250, 251, 253, 259, 327; 118/651, 653, 656–658, 661

[56] References Cited

U.S. PATENT DOCUMENTS

| | | | |
|---|---|---|---|
| 4,131,357 | 12/1978 | Forbes, 2nd | 355/251 |
| 4,324,483 | 4/1982 | Tagawa et al. | 118/658 X |
| 4,351,604 | 9/1982 | Karasawa et al. | 118/656 X |
| 4,481,903 | 11/1984 | Haberhauer et al. | 118/657 X |
| 4,498,755 | 2/1985 | Ohkubo et al. | 118/658 X |
| 4,533,229 | 8/1985 | Lu | 118/657 X |
| 4,571,071 | 2/1986 | Bothner | 355/327 X |
| 4,572,631 | 2/1986 | Kondo | 118/658 X |
| 4,609,280 | 9/1986 | Queener | 355/251 X |
| 4,679,527 | 7/1987 | Chang | 118/658 |
| 4,714,046 | 12/1987 | Steele et al. | 118/657 |
| 4,724,457 | 2/1988 | Abreu et al. | 118/657 X |
| 4,760,422 | 7/1988 | Seimiya et al. | 355/253 |
| 4,930,438 | 6/1990 | Demizu et al. | 118/651 |
| 4,933,727 | 6/1990 | Mizuma et al. | 355/327 |
| 4,960,069 | 10/1990 | Kaieda | 118/657 |
| 5,010,368 | 4/1991 | O'Brien | 355/259 |
| 5,012,287 | 4/1991 | Knapp | 355/259 X |
| 5,028,961 | 7/1991 | De Cecca | 355/245 X |
| 5,034,775 | 7/1991 | Folkins | 355/259 |
| 5,036,363 | 7/1991 | Iida et al. | 355/246 |
| 5,045,884 | 9/1991 | Ohira et al. | 355/245 |
| 5,065,192 | 11/1991 | Adkins et al. | 355/251 |
| 5,075,726 | 12/1991 | Itaya et al. | 355/246 |
| 5,091,749 | 2/1992 | Iida et al. | 355/246 |
| 5,095,340 | 3/1992 | Mahoney | 355/251 |
| 5,124,749 | 6/1992 | Bares | 355/245 X |
| 5,142,330 | 8/1992 | Hirano et al. | 355/259 |
| 5,151,739 | 9/1992 | Hediger | 355/245 |
| 5,160,969 | 11/1992 | Mizuma et al. | 355/245 X |
| 5,164,774 | 11/1992 | Tomita et al. | 355/245 |
| 5,168,319 | 12/1992 | Kimura et al. | 355/245 X |
| 5,172,170 | 12/1992 | Hays et al. | 355/259 |
| 5,198,866 | 3/1993 | Kimura et al. | 355/245 |
| 5,220,382 | 6/1993 | Hediger | 355/245 |
| 5,245,392 | 9/1993 | Behe et al. | 355/259 |
| 5,247,333 | 9/1993 | Yamamoto et al. | 355/245 |
| 5,325,163 | 6/1994 | Nishio | 355/260 |
| 5,384,628 | 1/1995 | Takami et al. | 355/245 X |
| 5,391,455 | 2/1995 | Bigelow | 355/245 X |

FOREIGN PATENT DOCUMENTS

| | | |
|---|---|---|
| 0352102 | 1/1990 | European Pat. Off. . |
| 0414455 | 2/1991 | European Pat. Off. . |
| 0437864 | 7/1991 | European Pat. Off. . |
| 2913197 | 10/1980 | Germany . |
| 3-180876 | 8/1991 | Japan . |
| WO91/08523 | 6/1991 | WIPO . |
| WO92/07307 | 4/1992 | WIPO . |

*Primary Examiner*—A. T. Grimley
*Assistant Examiner*—Shuk Y. Lee
*Attorney, Agent, or Firm*—Oblon, Spivak, McClelland, Maier & Neustadt

[57] ABSTRACT

A developing device using a one-component developer or toner and applicable to image forming equipment for supplying the developer to a photoconductive element disposed above the device. The device supplies a desired amount of toner to a toner supply roller and a developing roller at all times with no regard to the position thereof, thereby insuring stable images. Further, the device enhances free layout of the equipment and occupies a minimum of sectional area relative to the photoconductive element.

21 Claims, 8 Drawing Sheets

DEVELOPER HAVING A TONER HOPPER DISPOSED COMPLETELY BELOW THE IMAGING DRUM

This application is a Continuation of application Ser. No. 08/050,610, filed Apr. 22, 1993, now abandoned.

BACKGROUND OF THE INVENTION

The present invention relates to a developing device for use in a copier or similar image forming equipment and using a one-component developer, i.e., a toner.

It is a common practice to provide a developing device for the above application with a developing roller, a toner hopper storing a toner to be fed to the developing roller, and an agitator for driving the toner out of the toner hopper toward the developing roller. The developing roller, toner hopper and agitator are usually arranged side by side substantially in the horizontal direction. Hence, in a color copier or a color printer, for example, having three or four developing devices, the developing devices have to be arranged side by side substantially in the horizontal direction. This prevents various devices or units constituting, for example, a color copier from being freely laid out and, therefore, needs a large size photoconductive element, increasing the overall size of the copier. Moreover, it is likely that the toner is scattered around via the opening of the developing device to smear the equipment and to enter the following developing device which stores a toner of another color.

To eliminate the above problem, a developing device having a developing roller, toner hopper and so forth arranged in the vertical direction may be disposed below a photoconductive element to supply a developer upward to the element, as disclosed in, for example, Japanese Patent Laid-Open Publication Nos. 112753/1978, 185052/1982, and 223158/1983 which will respectively be referred to as Prior Art 1, 2 and 3 for convenience.

The developing device of Prior Art 1 is elaborated to surely supplement a toner, miniaturize the configuration, and promote free layout of a developing roller and a toner tank. A flexible thin member is constantly biased to in turn bias a toner stored in the toner tank against the developing roller. As a result, the toner is semiforcibly supplied to the developing roller until it has been fully consumed. This successfully eliminates so-called bridging of toner.

Prior Art 2 proposes a non-contact type developing device capable of causing a toner of predetermined polarity and potential to form a uniform thin layer by use of a pair of developing rollers. Specifically, a toner is deposited in a great amount on one developing roller. Only part of this toner having desired polarity and charge is transferred from the developing roller to the other developing roller by an electric force to form an about less than 300 microns thick layer thereon. The thickness of the toner layer is controlled on the basis of the peripheral speed of each roller or the gap between the rollers or the bias for development.

Further, Prior Art 2 teaches a developing device which allows a toner to be fed to a developer carrier in any desired direction so as to enhance design freedom. Specifically, the device has a bag implemented by an elastic thin film and in which a developer is packed against the elasticity of the bag. As the elastic bag contracts, the developer is urged against the surface of a developer carrier.

However, the problem with Prior Art 1 is that the toner supplied to the developing roller is not sufficiently charged and, therefore, apt to come off from the roller due to the small electrostatic force between the toner and the roller. As a result, much of the toner is scattered around before reaching a frictional charging member, contaminating the surroundings. The leakage of the toner is aggravated since a pressure constantly acts on the opening of the developing device.

Prior Art 2 selects a predetermined part of the toner out of the toner layer whose charge has not been fully controlled and, therefore, causes the toner with undesired charges to sequentially accumulate. It follows that charge control matching the charging ability has to be executed from time to time, resulting in the need for exclusive sensing means. Moreover, despite the control of the charge of the toner to a predetermined one, image quality cannot be maintained constant since the toner repetitively discriminated by electric means has changed the particle size and characteristic thereof.

Prior art 3 has a drawback that the contraction of the bag acts in various directions since the toner is packed in the bag against the elasticity of the bag. Specifically, the device of Prior Art 3, like the device of Prior Art 1, constantly exerts a pressure on the opening of the bag. This makes it difficult to seal the opening of the bag and that of the device. Defective sealing would cause the toner to fly out of the bag and device. Particularly, when an application roller is disposed in the bag, it aggravates the movement of the toner and, therefore, the leakage of the toner. Moreover, when the bag is scratched or otherwise damage, it will break up to scatter the toner. In addition, the pressure constantly acting on the toner stored in the bag causes the toner to cohere, thereby lowering image density or otherwise degrading image quality.

The problem with all of the conventional developing devices described above is that since they supply the toner upward to the photoconductive element, the toner cannot be transported over a substantial distance without increasing the load for structural reasons.

SUMMARY OF THE INVENTION

It is therefore an object of the present invention to provide a developing device which prevents a toner from falling or flying around without effecting the free layout of an image forming apparatus in which it is incorporated.

In accordance with the present invention, a developing device for image forming equipment having an image carrier for carrying an electrostatic latent image comprises a casing disposed below and facing the image carrier and formed with an opening facing the image carrier, a developer carrier accommodate in the casing and partly exposed through the opening of the casing, a supply member for supplying a developer to the developer carrier, and a conveyor member located upstream of a position where the developer is to be transferred from the supply member to the developer carrier with respect to an intended direction of movement of the supply member for conveying the developer in at least the longitudinal direction of the supply member.

Also, in accordance with the present invention, a developing device for image forming equipment having an image carrier for carrying an electrostatic latent image comprises a casing disposed below and facing the image carrier and formed with an opening facing the image carrier, a developer carrier accommodated in the casing and partly exposed through the opening of the casing, a supply member for supplying a developer to the developer carrier, a first conveyor member located upstream of a position where the developer is to be transferred from the supply member to the developer carrier with respect to an intended direction of movement of the supply member for conveying the developer in at least the longitudinal direction of the supply member, and a second conveyor member located upstream of the first conveyor member with respect to the intended direction of movement of the supply member for transporting the developer in a direction opposite to a direction in which the first conveyor member transports the developer.

Further, in accordance with the present invention, a developing device for image forming equipment having an image carrier for carrying an electrostatic latent image comprises a casing disposed below and facing the image carrier and formed with an opening facing the image carrier, a developer carrier accommodated in the casing and partly exposed through the opening of the casing, a supply member for supplying a developer to the developer carrier, and a conveyor member disposed in a developer transport space delimited by at least the casing, developer carrier and supply member for transporting the developer in at least the longitudinal direction of the supply member.

Moreover, in accordance with the present invention, a developing device for image forming equipment having an image carrier for carrying an electrostatic latent image comprises a casing disposed below and facing the image carrier and formed with an opening facing the image carrier, a developer carrier accommodated in the casing and partly exposed through the opening of the casing, and a supply member for supplying a developer to the developer carrier. The supply member comprises an elastic roller which partly contacts the casing.

Furthermore, a developing device for image forming equipment having an image carrier for carrying an electrostatic latent image of the present invention comprises a casing disposed below and facing the image carrier and formed with an opening facing the image carrier, a developer carrier accommodated in the casing and partly exposed through the opening of the casing, a supply member for supplying a developer to the developer carrier, a toner storing section provided at one side of the device for storing the developer, and a conveyor member located upstream of a position where the developer is to be transferred from the supply member to the developer carrier with respect to an intended direction of movement of the supply member for transporting the developer in the longitudinal direction of the supply member.

Furthermore, a developing device for image forming equipment having an image carrier for carrying an electrostatic latent image comprises a casing disposed below and facing the image carrier and formed with an opening facing the image carrier, a developer carrier accommodated in the casing and partly exposed through the opening of the casing, a supply member for supplying a developer to the developer carrier, a conveyor member located upstream of a position where the developer is to be transferred from the supply member to the developer carrier with respect an intended direction of movement of the supply member for transporting the developer in at least the longitudinal direction of the supply member, and a sensor for sensing an amount of the developer at a position upstream of the position with respect to the intended direction of movement of the supply member. The conveyor member is driven when the sensor determines that the amount of developer is smaller than a predetermined amount.

In addition, a developing device for image forming equipment having an image carrier for carrying an electrostatic latent image of the present invention comprises a casing disposed below and facing the image carrier and formed with an opening facing the image carrier, a developer carrier accommodated in the casing and partly exposed through the opening of the casing, a supply member for supplying a developer to the developer carrier, a first conveyor member located upstream of a position where the developer is transferred from the supply member to the developer carrier with respect to an intended direction of movement of the supply member for transporting the developer in at least the longitudinal direction of the supply member, and a second conveyor member disposed above the first conveyor member for transporting the developer in a direction opposite to a direction in which the first conveyor member transports the developer.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
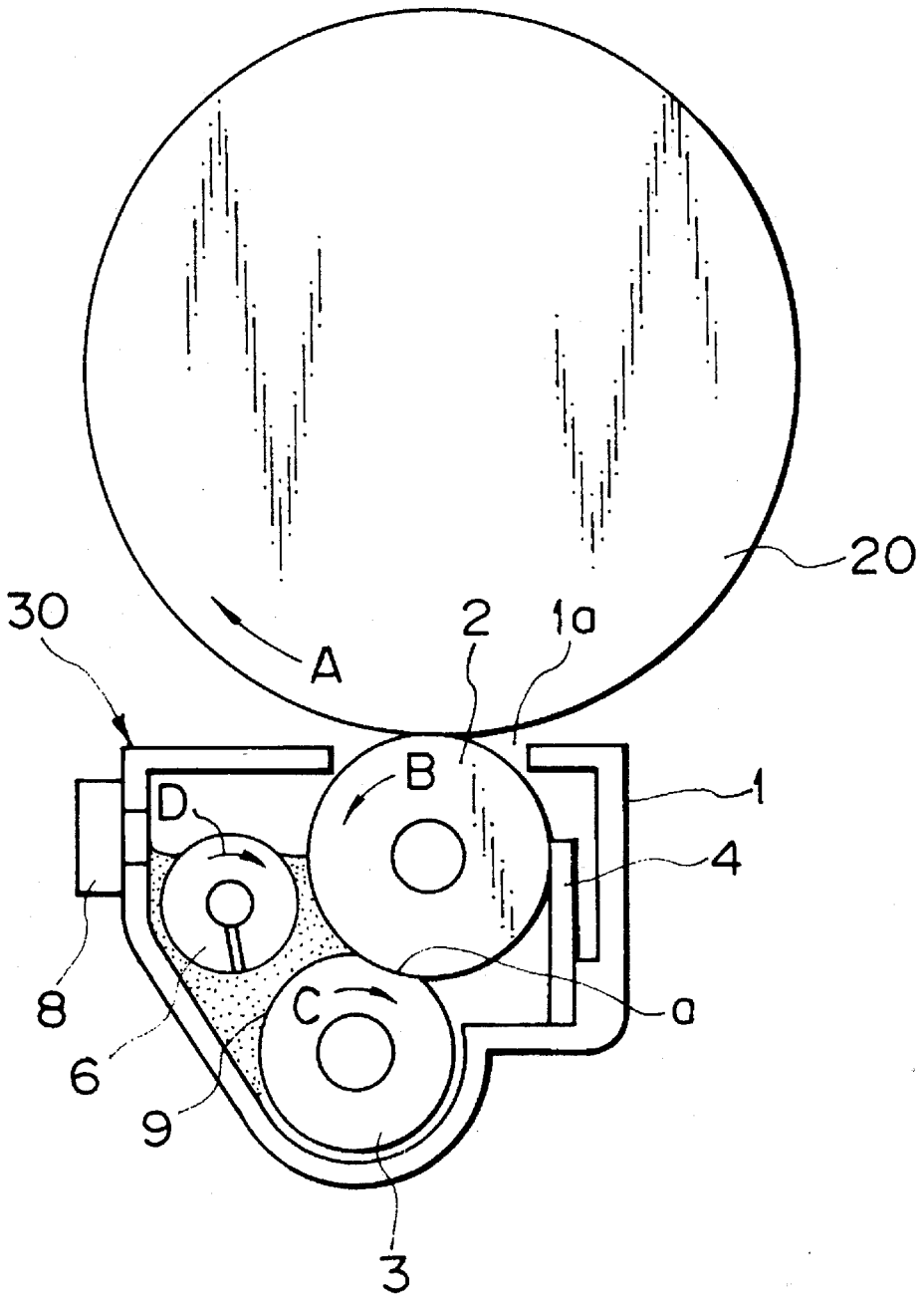
FIG. 1 is a sectional front view of a developing device embodying the present invention.

Referring to FIG. 1 of the drawings, a developing device embodying the present invention is shown which is applicable to a copier or similar image forming apparatus. As shown, the developing device, generally 30, is disposed below an image carrier implemented as a photoconductive drum 20. While the drum 20 is rotated in a direction indicated by an arrow A in the figure, the developing device 30 deposits a non-magnetic one-component carrier, i.e., a toner on a latent image electrostatically formed on the drum 20. The device 30 includes a casing 1 having an opening 1*a* at the top thereof. A developer carrier in the form of a developing roller 2 is disposed in the casing 1 to face the drum 20 via the opening 1*a* of the casing 1. The developing roller 2 is rotated at a predetermined peripheral speed ratio to the drum 20 and in a direction B identical with the direction A as observed at the position where the roller 2 contacts the drum 20. A toner supply roller, or simply supply roller as referred to hereinafter, 3 is positioned below the developing roller 2 and made of foam polyurethane or similar elastic material. The supply roller 3 slidingly contacts the developing roller 2 at a predetermined peripheral speed ratio to the roller 3. At a position α where the supply roller 3 contacts the developing roller 2, the former is rotated in the same direction C as the latter. At this position α, toner is transferred from the supply roller 3 to the developing roller 2. A blade 4 is made of urethane rubber or similar elastic material and located at a position downstream of the position a with respect to the direction B and adjoining the opening 1*a* of the casing 1. The blade 4 is held in contact with the periphery of the developing roller 2 at one end thereof. A screw-like conveyor member 6 is also disposed in the casing 1 and conveys the toner from the viewer's side to the opposite side in the direction perpendicular to the sheet surface of FIG. 1.

Figure 2:
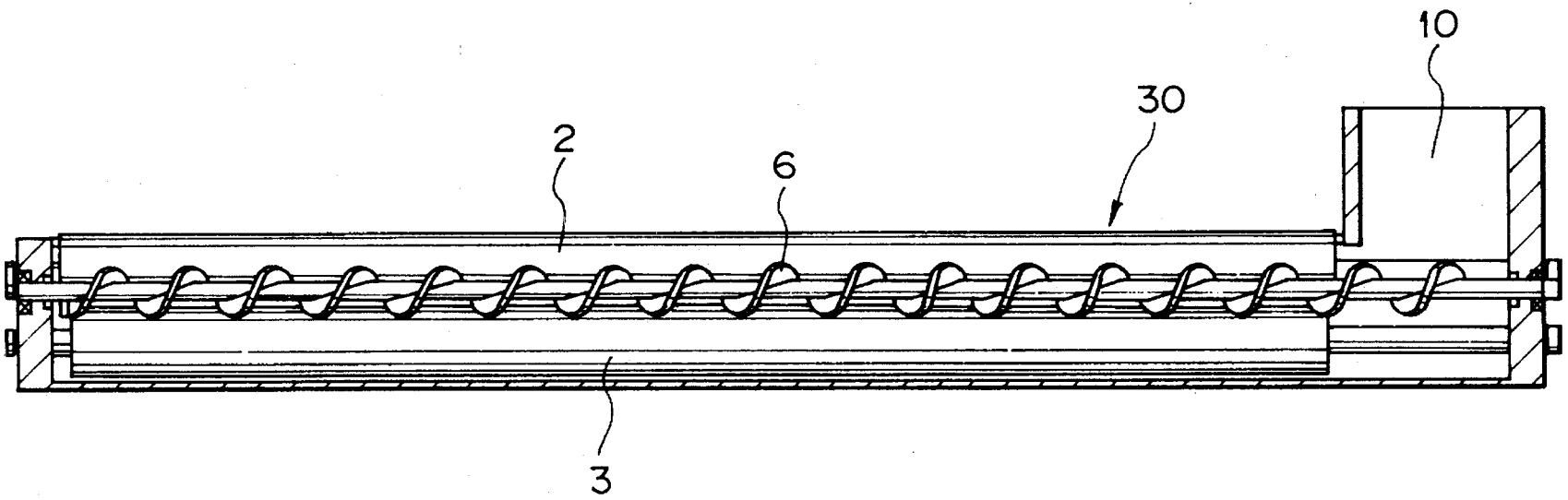
FIG. 2 is a sectional side elevation of the embodiment.

As shown in FIG. 2, a toner storing section or hopper 10 is provided on the viewer's side of the developing device 30, i.e., on the front side of the image forming apparatus. The conveyor member 6 extends from the hopper 10 in the direction perpendicular to the sheet surface of FIG. 1 in parallel with the developing roller 2 and supply roller 3. A drive mechanism, not shown, controllably drives the conveyor member 6 in a direction D independently of the developing roller 2 and supply roller 3. A seal 9 is accommodated in the casing 1 and implemented as an elastic sheet. Part of the seal 9 is held in contact with the periphery of the supply roller 3. In this configuration, the developing roller 2, supply roller 3, seal 9 and casing 1 form a toner transport space. The conveyor member 6 is disposed in the toner transport space and conveys the toner out of the hopper 10 toward the upstream side of the previously mentioned position α with respect to the direction C in which the supply roller 3 rotates.

Also shown in FIG. 1 is a pressure-sensitive sensor 8 which senses an amount of toner existing in the casing 1. Specifically, when the toner remaining in the casing 1 decreases to below a predetermined level, the sensor 8 generates a signal indicative of such a toner level. In response, the drive of the conveyor member 6 is controlled to convey the toner out of the hopper 10. As a result, the amount of toner in the above-stated toner transport space is maintained substantially constant.

In operation, the toner in the transport space is transferred from the supply roller 3 to the developing roller 2 at the position α while being charged by friction. The toner deposited on the developing roller 2 is leveled by the blade 4 to form a thin toner layer having a predetermined thickness. The developing roller 2 carrying such a toner layer develops a n electrostatic latent image formed on the surface of the drum 20 in or out of contact with the drum 20.

Figure 3:
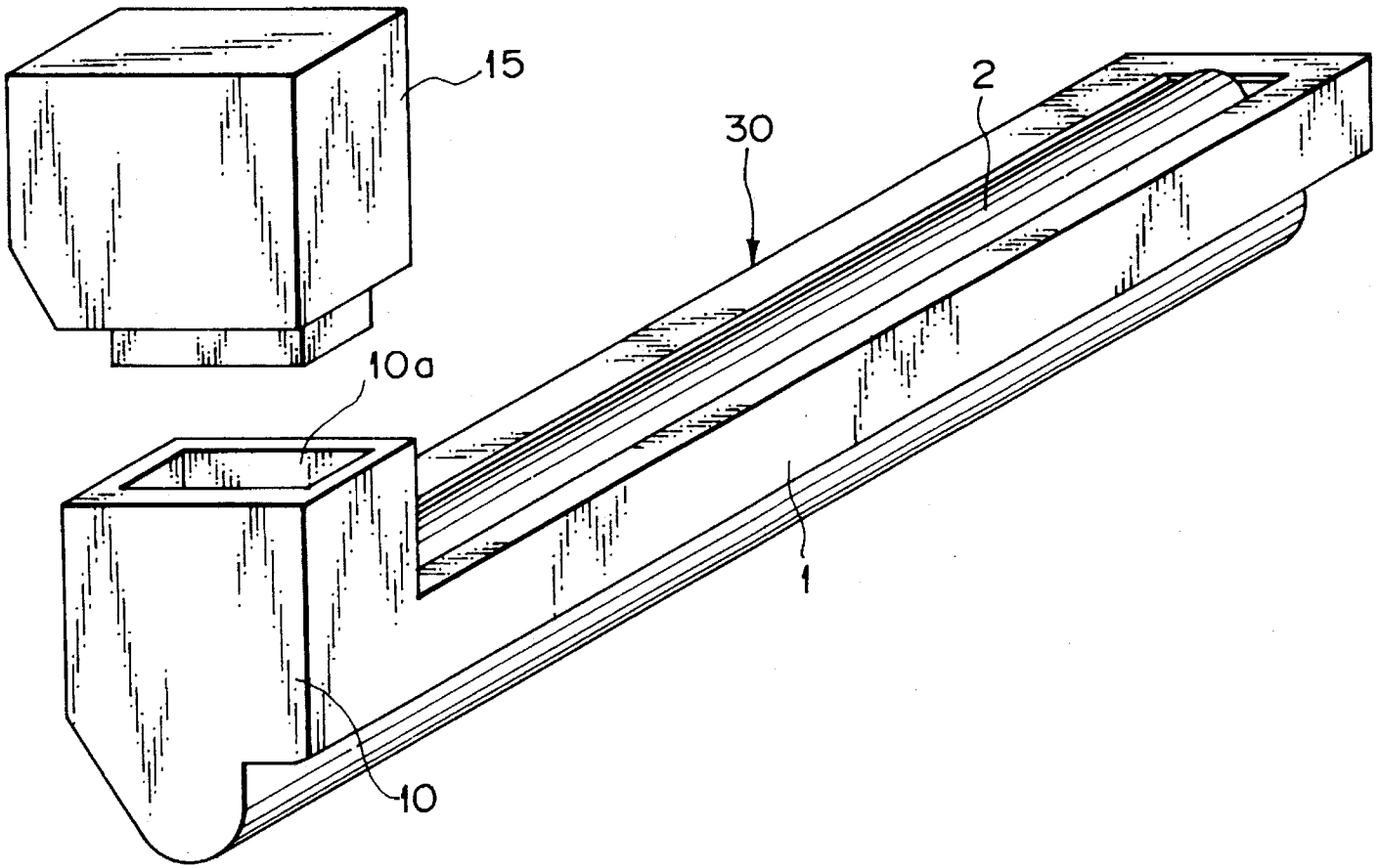
FIG. 3 is an external view of the embodiment.

FIG. 3 shows the developing device 30 in a perspective view. As shown, the hopper 10 has an opening 10*a* at the top thereof. A toner cartridge 15 has an opening which is sealed by a closure member implemented as a sheet, although not shown in the figure. After the toner cartridge 15 has been mounted on the hopper 10 with the opening thereof aligned with the opening 10*a* of the hopper 10, the seal or closure member thereof is removed to feed a toner to the hopper 10.

Figure 4:
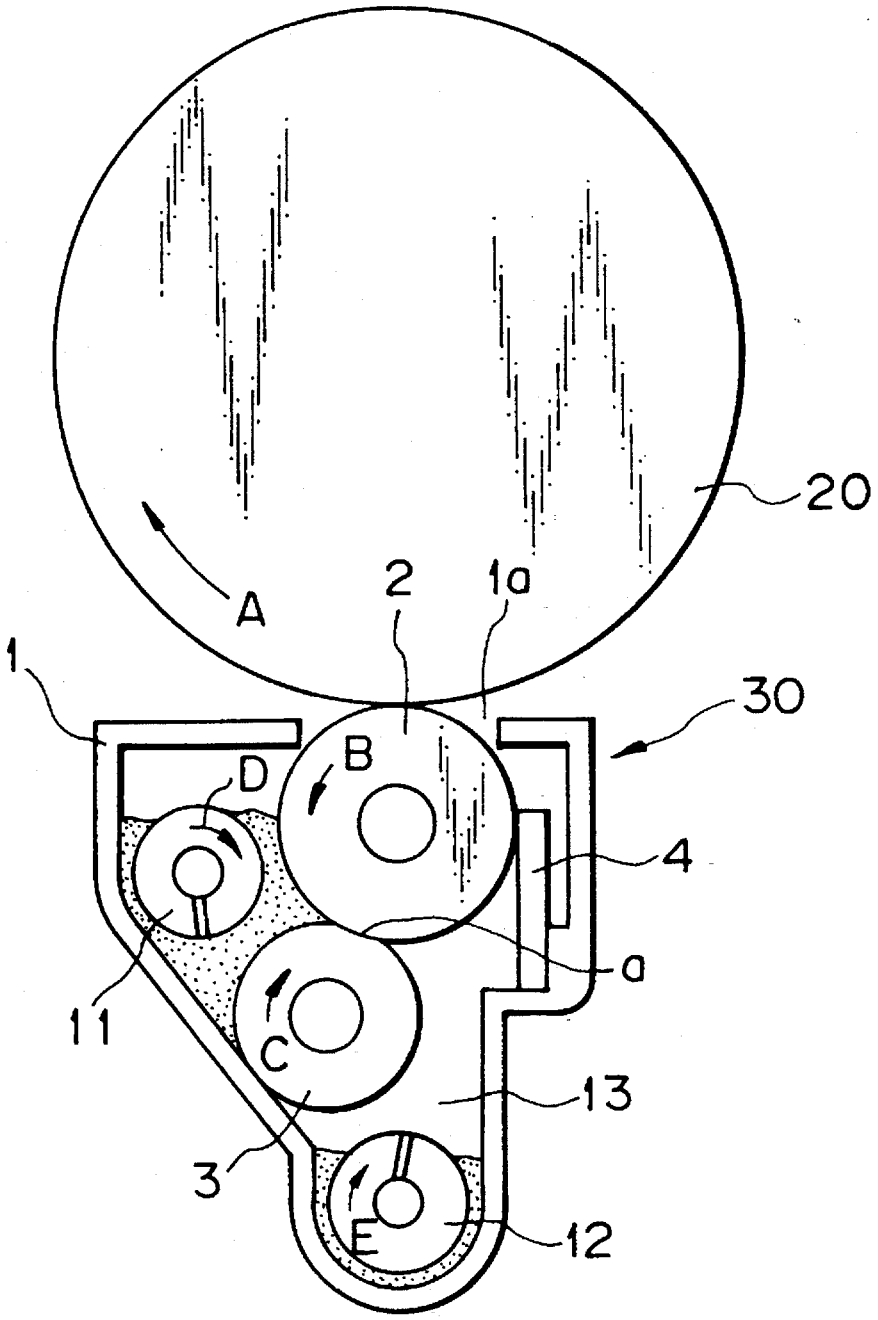
FIG. 4 is a sectional front view of an alternative embodiment of the present invention.
Figure 5:
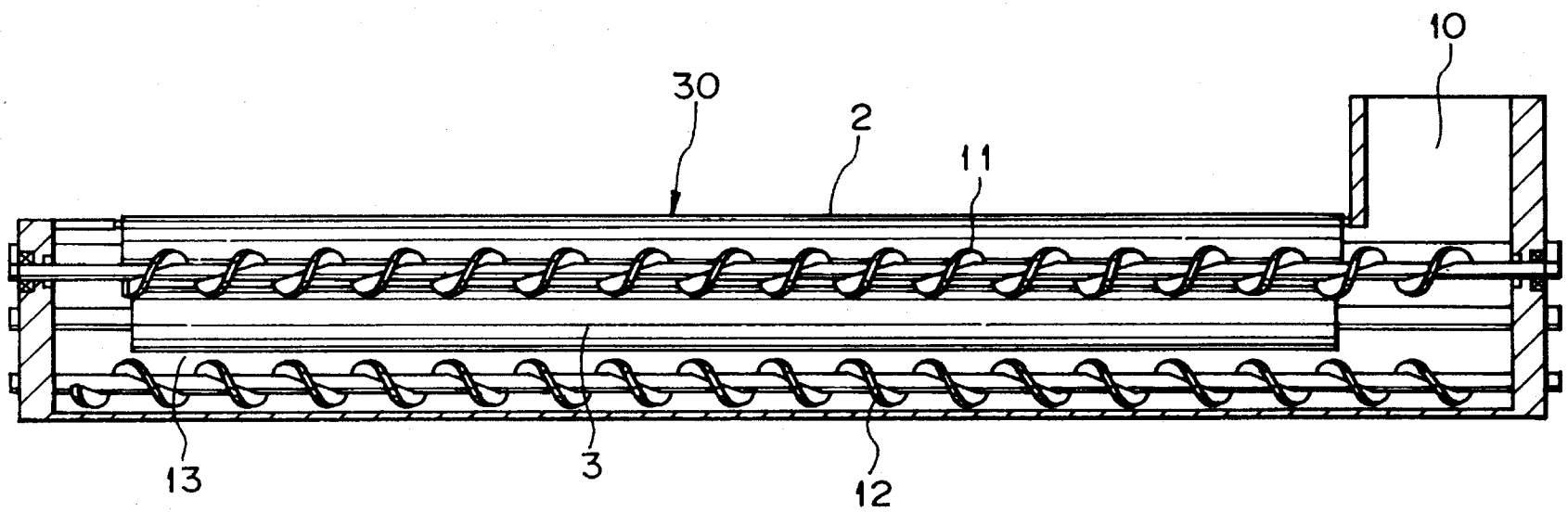
FIG. 5 is a sectional side elevation of the embodiment shown in FIG. 4.

Referring to FIGS. 4 and 5, an alternative embodiment of the present invention will be described. In this embodiment, the same or similar constituents as or to those of the previous embodiment are designated by the same reference numerals, and a detailed description will not be made in order to avoid redundancy. As shown, a first screw-like conveyor member 11 is disposed in the casing 1 to play the role of the conveyor member 6. The elastic supply roller 3 is held in contact with both the developing roller 2 and casing 1. The developing roller 2, supply roller 3 and casing 1 form a toner transport space surrounding the conveyor member 11.

In the illustrative embodiment, the conveyor member 11 is rotated in association with and at predetermined peripheral speed ratios to the developing roller 2 and supply roller 3. The conveyor member 11, therefore, conveys the toner from the hopper 10 into the toner transport space so as to feed it to the supply roller 3. The supply roller 3 supplies the toner to the surface of the developing roller 2 while frictionally charging it in cooperation with the roller 2. The toner deposited on the developing roller 2 is leveled by the blade 4 to form a toner layer having a predetermined thickness. The developing roller 2 carrying such a toner layer develops a latent image formed on the drum 20 in or out of contact with the drum 20.

The toner not contributed to the development is conveyed by the conveyor member 11 to the other side of the device 30 opposite to the hopper 10. A communication passage or toner circulation passage 13 is defined at the outside of the effective diameters of the rollers 2 and 3. The toner transported by the conveyor member 11 to the toner circulation passage 13 is dropped to the bottom of the casing 1 by gravity. A second screw-like conveyor member 12 is located in close proximity to the bottom of the casing 1 and extends in parallel to the rollers 2 and 3 and first conveyor member 11. The second conveyor member 12 is rotated in such a manner as to convey the toner in the opposite direction to the conveyor member 11, thereby returning the excessive part of the toner not used by the development to the hopper 10. By merely selecting adequate amounts of toner to be transported by the two conveyor members 11 and 12, there can be implemented a developing device capable of feeding the toner to the supply roller 3 without resorting to complicated control, promoting the free layout of the equipment, and occupying a minimum of sectional area relative to the drum 20.

Figure 6A:
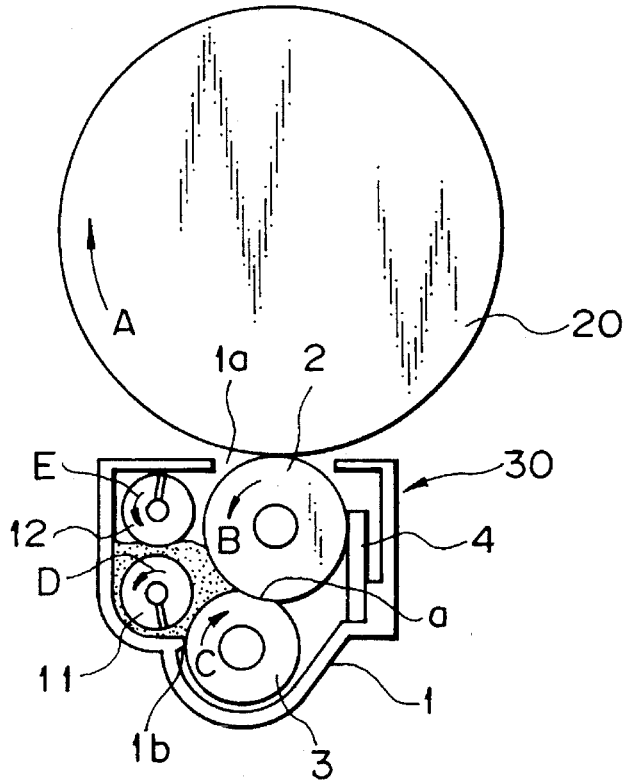
FIGS. 6A and 6B are sections showing another alternative embodiment of the present invention in particular conditions.
Figure 6B:
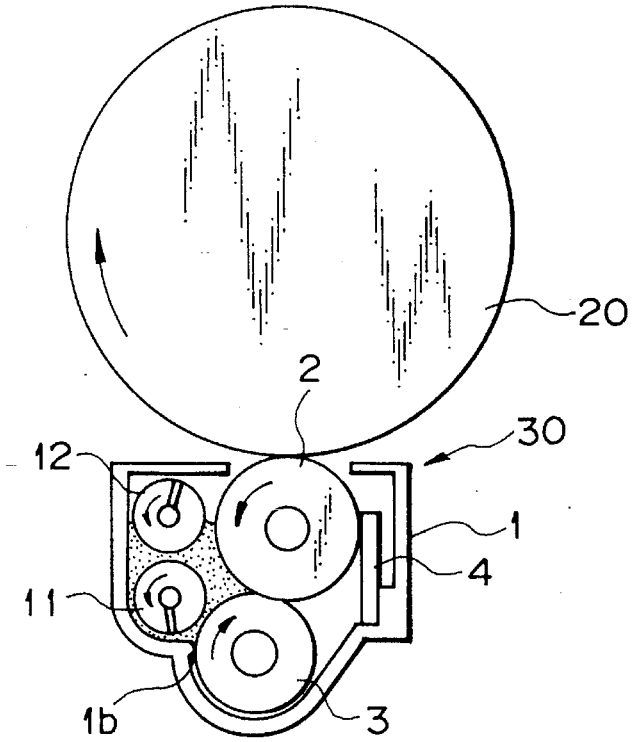
Figure 7:
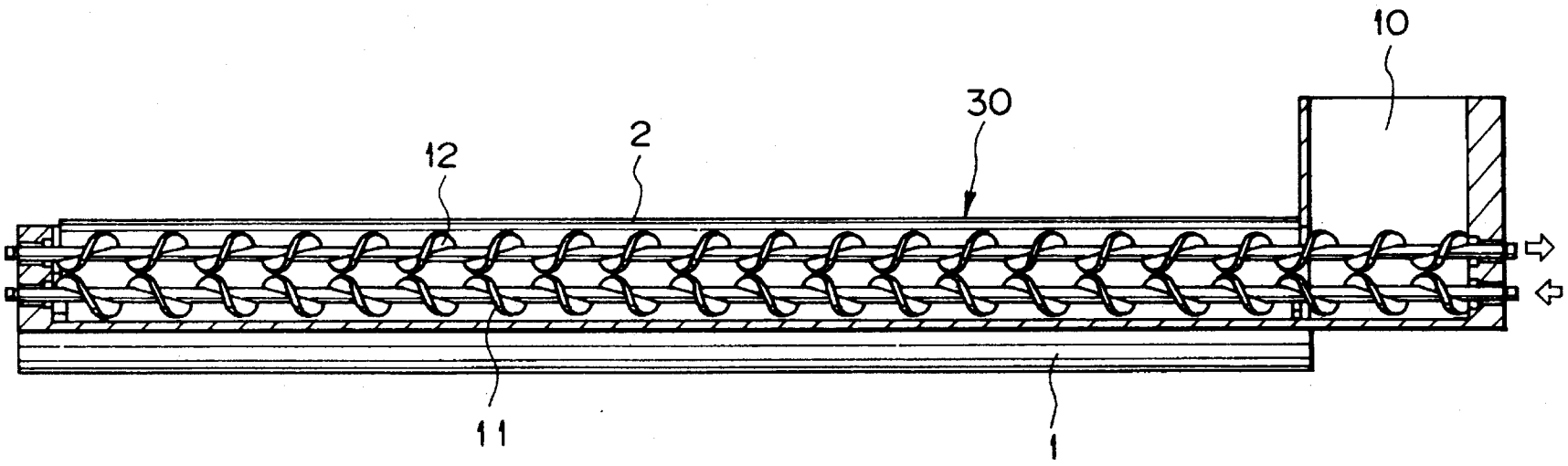
FIG. 7 is a sectional side elevation showing another alternative embodiment of the present invention.

FIGS. 6A, 6B and 7 show another alternative embodiment of the present invention which is essentially similar to the embodiment of FIG. 4 except for the following. As shown, a rib 1*b* extends from part of the inner periphery of the casing 1 and contacts the supply roller 3. In this configuration, the developing roller 2, toner supply roller 3 and casing 1 define a toner transport space surrounding the first conveyor member 11. The second conveyor member 12 is disposed above the first conveyor member 11 to extend in parallel to the developing roller 2, supply roller 3, and conveyor member 11. The conveyor member 12 is rotated in the opposite direction to the conveyor member 11, as in the previous embodiment.

Generally, a greater amount of toner than the maximum amount of toner to be consumed by development should constantly exist in the toner transport space surrounding the conveyor member 11. However, the problem is that the amount of toner consumption depends on the total area of an image to be developed and the image arrangement in the widthwise direction. The toner in the transport space is conveyed to and accumulated at the side of the developing device 30 opposite to the hopper 10. Further, the distribution of the toner in the widthwise direction of the transport space is not uniform since the amount of toner consumption in the widthwise direction of the device 30 depends on the image size (paper size), image layout, image area, etc.

In this embodiment, the second conveyor member 12 is disposed above the first conveyor member 11 and rotated in the opposite direction to the member 11. As shown in FIG. 6A, so long as the level of the toner existing in the transport space is lower than the level where the conveyor member 12 is positioned, the toner is transported by the conveyor member 11 away from the hopper 10 to the other side of the developing device 30. As shown in FIG. 6B, as the level of the toner in the toner transport space reaches the transport level of the conveyor member 12, i.e., the amount of toner becomes excessive, the excessive part of the toner is transported toward the hopper 10, i.e., toward the viewer's side by the conveyor 12. The conveyor member 12, therefore, supplements the portions where the toner is low while returning the excessive toner to the hopper 10. As a result, the amount of toner in the transport space is maintained constant, and the toner distribution in the widthwise direction is also maintained substantially constant.

Figure 8:
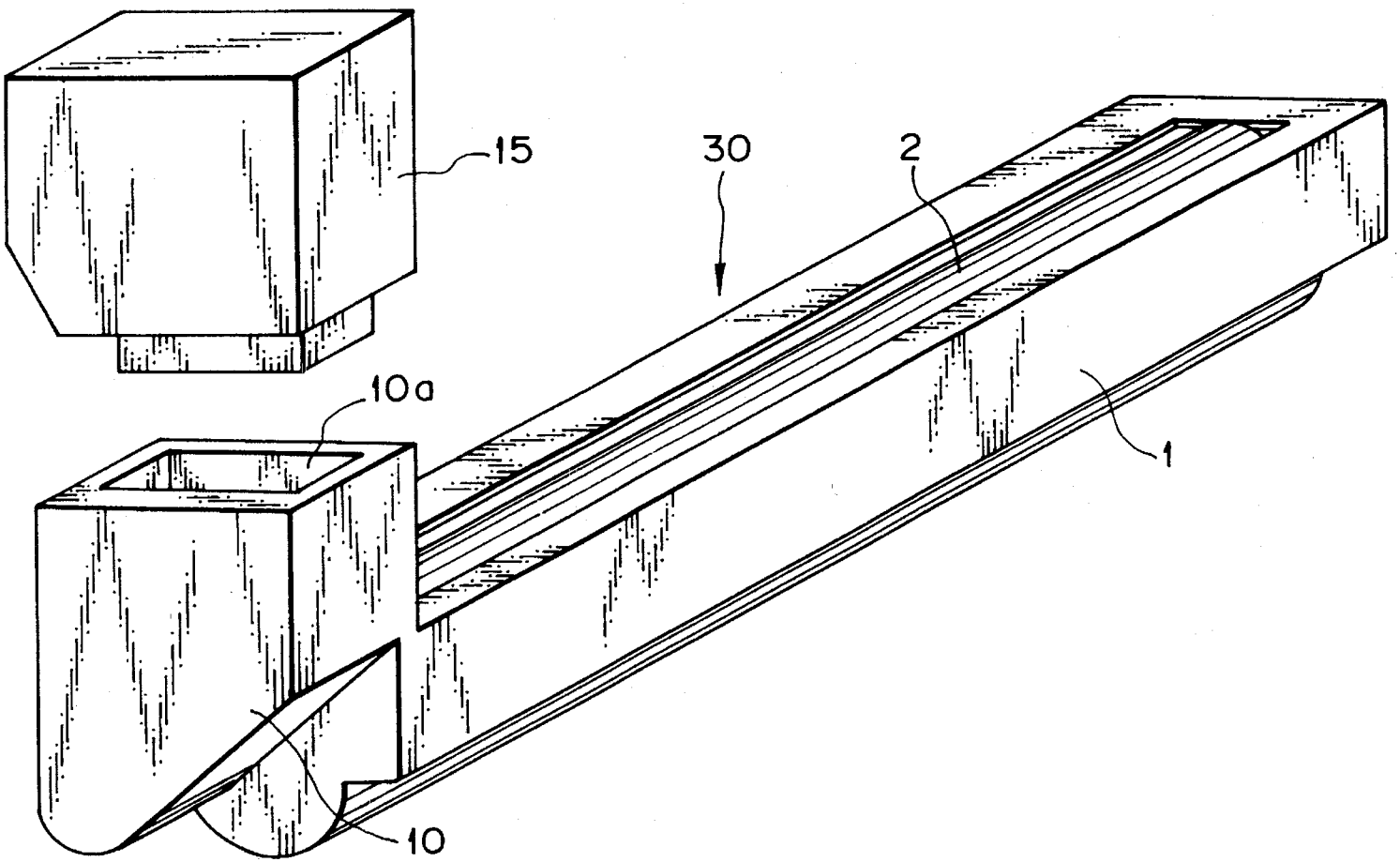
FIG. 8 is a perspective view of still another alternative embodiment of the present invention.

FIG. 8 shows the developing device 30 of the illustrative embodiment in a perspective view. As shown, the hopper 10 has an opening 10*a* at the top thereof. A toner cartridge 15 has an opening which is sealed by a closure member implemented as a sheet, although not shown in the figure. After the toner cartridge 15 has been mounted on the hopper 10 with the opening thereof aligned with the opening 10*a* of the hopper 10, the seal or closure member thereof is removed to feed a toner to the hopper 10.

In summary, it will be seen that the present invention provides a developing device having various unprecedented advantages, as enumerated below.

(1) The device supplies a required amount of toner to a toner supply roller and a developing roller at all times, provides image forming equipment with great freedom of layout, and needs a minimum of sectional space relative to a photoconductive element and, therefore, has a miniature configuration.

(2) By merely selecting adequate amounts of transport of the first and second conveyor members, the device insures a uniform developer (toner) distribution in the longitudinal direction thereof without resorting to complicated control.

(3) Having a toner transport space, the device allows the conveyor members to transport the toner efficiently and supplies the toner to a toner supply roller stably at all times with a minimum of sectional space.

(4) The toner supply roller is made of an elastic material and partly held in rollable contact with the casing of the device, so that the toner transport space can be formed without resorting to any special member. In addition, the toner is prevented from cohering and sticking to, for example, the surface of the supply roller, so that stable toner supply is insured.

(5) If the amounts of transport of the first and second conveyor members are adequately selected, the excessive part of the toner not contributed to development is conveyed in opposite direction. Therefore, the toner can be fed to the toner supply roller without any control.

(6) A space or passage is formed between the first and second conveyor members to absorb a change in the amount of excessive toner, thereby promoting smooth toner transport.

(7) A toner hopper is located at one side of the device. This allows a sufficient amount of toner to be stored in the hopper without increasing the sectional area which the device occupies relative to the photoconductive element. Therefore, the toner is fed from the hopper in a stable manner.

(8) The second conveyor member returns the excessive developer to the hopper, i.e., saves it by circulation.

(9) The hopper located at one side, particularly the front side, of the device facilitates the supply of a fresh toner to the device. Hence, when the toner in the hopper decreases to a toner end level, a fresh toner can be supplied immediately.

(10) Since the conveyor members are driven by a sensor signal, the toner is free from loads and protected from mechanical deterioration.

(11) Since the device enhances free layout and miniature configuration, it is feasible for, among others, color image forming equipment having a plurality of developing units with no regard to the kind of a photoconductive element, i.e., a drum or a belt. As a result, the entire image forming equipment is reduced in size.

(12) The casing of the device can be oriented such that an opening thereof faces upward. This prevents the toner from being scattered around out of the casing.

Various modifications will become possible for those skilled in the art after receiving the teachings of the present disclosure without departing from the scope thereof.

What is claimed is:

1. A developing device for image forming equipment having an image carrier for carrying an electrostatic latent image, comprising:

a casing disposed below and facing the image carrier and formed with an opening facing said image carrier;

a developer carrier accommodated in said casing and partly exposed through said opening of said casing;

a supply member, having a longitudinal axis, for supplying a developer to said developer carrier wherein said developer is stored within said casing such that substantially all of said developer is stored above said longitudinal axis of said supply member;

a first conveyor member located upstream of a position where the developer is to be transferred from said supply member to said developer carrier with respect to an intended direction of movement of said supply member for conveying said developer in at least a longitudinal direction of said supply member; and a second conveyor member disposed below said first conveyor member for transporting the developer in a direction opposite to a direction in which said first conveyor member transports said developer.

2. A developing device for image forming equipment having an image carrier for carrying an electrostatic latent image, comprising:

a casing disposed below and facing the image carrier and formed with an opening facing said image carrier;

a developer carrier accommodated in said casing and partly exposed through said opening of said casing;

a supply member, having a longitudinal axis, for supplying a developer to said developer carrier, wherein said developer is stored within said casing such that substantially all of said developer is stored above said longitudinal axis of said supply member;

a first conveyor member located upstream of a position where the developer is to be transferred from said supply member to said developer carrier with respect to an intended direction of movement of said supply member for conveying said developer in at least a longitudinal direction of said supply member; and a second conveyor member disposed below said first conveyor member for transporting the developer in a direction opposite to a direction in which said first conveyor member transports said developer, wherein said second conveyor member transports excessive part of the developer transported by said first conveyor member and not contributed to development.

3. A developing device for image forming equipment having an image carrier for carrying an electrostatic latent image, comprising:

a casing disposed below and facing the image carrier and formed with an opening facing said image carrier;

a developer carrier accommodated in said casing and partly exposed through said opening of said casing;

a supply member, having a longitudinal access, for supplying a developer to said developer carrier, wherein said developer is stored within said casing such that substantially all of said developer is stored above said longitudinal axis of said supply member;

a first conveyor member located upstream of a position where the developer is to be transferred from said supply member to said developer carrier with respect to an intended direction of movement of said supply member for conveying said developer in at least a longitudinal direction of said supply member; and a second conveyor member disposed below said first conveyor member for transporting the developer in a direction opposite to a direction in which said first conveyor member transports said developer, further comprising a communication passage for transferring excessive part of the developer transported by said first conveyor member and not contributed to development to said second conveyor member.

4. A developing device for imaging forming equipment having an image carrier for carrying an electrostatic latent image, comprising:

a casing disposed completely below and facing the image carrier and formed with an opening facing said image carrier;

a developer carrier accommodated in said casing and partly exposed through said opening of said casing;

a supply member, having a longitudinal axis, for supplying a developer to said developer carrier, wherein said developer is stored within said casing such that substantially all of said developer is stored above said longitudinal axis of said supply member;

a toner storing section provided at one side of said device for storing the developer; and a conveyor member located upstream of a position where the developer is to be transferred from said supply member to said developer carrier with respect to an intended direction of movement of said supply member for transporting said developer in a longitudinal direction of said supply member, further comprising a second conveyor member for transporting excessive part of the developer not contributed to development to said toner storing section.

5. A developing device for image forming equipment having an image carrier for carrying an electrostatic latent image, comprising:

a casing disposed below and facing the image carrier and formed with an opening facing said image carrier;

a developer carrier accommodated in said casing and partly exposed through said opening of said casing;

a supply member, having a longitudinal axis, for supplying a developer to said developer carrier wherein said developer is stored within said casing such that substantially all of said developer is stored above said longitudinal axis of said supply member;

a first conveyor member located upstream of a position where the developer is transferred from said supply member to said developer carrier with respect to an intended direction of movement of said supply member for transporting said developer in at least a longitudinal direction of said supply member; and a second conveyor member disposed above said first conveyor member for transporting the developer in a direction opposite to a direction in which said first conveyor member transports said developer.

6. A developing device for image forming equipment having an image carrier for carrying an electrostatic latent image, said device comprising:

a casing disposed completely below and facing the image carrier and formed with an opening facing said image carrier;

a developer carrier accommodated in said casing and partly exposed through said opening of said casing;

a supply member for supplying a developer to said developer carrier;

a developer transport space defined in said casing by at least said developer carrier, said supply member and said casing; and a conveyor member disposed in said developer transport space and located upstream of a contact position where said developer carrier contacts said supply member and the developer is to be transferred from said supply member to said developer carrier with respect to an intended direction of movement of said supply member for conveying said developer in at least a longitudinal direction of said supply member, substantially all of said developer transport space being located above said contact position.

7. A developing device as claimed in claim 6, wherein said conveyor member comprises a rotary screw located at a level higher than that of said contact position.

8. A developing device as claimed in claim 6, further comprising a developer storing section provided at one side of said device for storing the developer.

9. A developing device as claimed in claim 8, further comprising a second conveyor member for conveying an excessive part of the developer which does not contribute to development to said developer storing section.

10. A developing device as claimed in claim 8, wherein said developer storing section is located at one side of said device corresponding to a front side of the image forming equipment.

11. A developing device as claimed in claim 6, further comprising sensing means for sensing an amount of the developer at a position upstream of said contact position with respect to the intended direction of movement of said supply member, said conveyor member being driven when said sensing means determines that the amount of developer is smaller than a predetermined amount.

12. A developing device for image forming equipment having an image carrier for carrying an electrostatic latent image, said device comprising:

a casing disposed completely below and facing the image carrier and formed with an opening facing said image carrier;

a developer carrier accommodated in said casing and partly exposed through said opening of said casing;

a supply member for supplying a developer to said developer carrier;

a developer transport space included in said casing and defined by at least said developer carrier, said supply member and said casing;

a first conveyor member disposed in said developer transport space and located upstream of a contact position where said developer carrier contacts said supply member and the developer is to be transferred from said supply member to said developer carrier with respect to an intended direction of movement of said supply member for conveying said developer in at least a longitudinal direction of said supply member, substantially all of said developer transport space being located above said contact position; and a second conveyor member disposed below said first conveyor member for conveying the developer in a direction opposite to a direction in which said first conveyor member conveys said developer.

13. A developing device as claimed in claim 12, wherein said first conveyor member comprises a rotary screw located at a level higher than that of said contact position.

14. A developing device as claimed in claim 12, wherein said second conveyor member conveys an excessive part of the developer conveyed by said first conveyor member which does not contribute to development.

15. A developing device as claimed in claim 12, further comprising a communication passage for transferring an excessive part of the developer conveyed by said first conveyor member which does not contribute to development to said second conveyor member.

16. A developing device for image forming equipment having an image carrier for carrying an electrostatic latent image, said device comprising:

a casing disposed completely below and facing the image carrier and formed with an opening facing said image carrier;

a developer carrier accommodated in said casing and partly exposed through said opening of said casing;

a supply member for supplying a developer to said developer carrier; and a conveyor member disposed in a developer transport space delimited by at least said casing, said developer carrier and said supply member for conveying the developer in at least a longitudinal direction of said supply member, substantially all of said developer transport space being formed above a contact position where said developer carrier contacts said supply member.

17. A developing device as claimed in claim 16, wherein said conveyor member comprises a rotary screw located at a level higher than that of said contact position.

18. A developing device for image forming equipment having an image carrier for carrying an electrostatic latent image, said device comprising:

a casing disposed completely below and facing the image carrier and formed with an opening facing said image carrier;

a developer carrier accommodated in said casing and partly exposed through said opening of said casing;

a supply member for supplying a developer to said developer carrier, said supply member comprising an elastic roller which partly contacts said casing; and a developer transport space defined in said casing by at least said developer carrier, said supply member and said casing and formed above a contact position where said developer carrier contacts said supply member.

19. A developing device for image forming equipment having an image carrier for carrying an electrostatic latent image, said device comprising:

a casing disposed completely below and facing the image carrier and formed with an opening facing said image carrier;

a developer carrier accommodated in said casing and partly exposed through said opening of said casing;

a supply member for supplying a developer to said developer carrier;

a developer transport space defined in said casing by at least said developer carrier, said supply member and said casing;

a first conveyor member disposed in said developer transport space and located upstream of a contact position where said developer carrier contacts said supply member and the developer is to be transferred from said supply member to said developer carrier with respect to an intended direction of movement of said supply member for conveying said developer in at least a longitudinal direction of said supply member, substantially all of said developer transport space being located above said contact position; and a second conveyor member disposed above said first conveyor member in said developer transport space for conveying the developer in a direction opposite to a direction in which said first conveyor member conveys said developer.

20. A developing device as claimed in claim 19, wherein said first conveyor member comprises a rotary screw located at a level higher than that of said contact position.

21. A developing device for image forming equipment having an image carrier for carrying an electrostatic latent image, said device comprising:

a casing disposed completely below and facing the image carrier and formed with an opening facing said image carrier;

a developer carrier accommodated in said casing and partly exposed through said opening of said casing;

a supply member for supplying a developer to said developer carrier;

a developer transport space defined in said casing by at least said developer carrier, said supply member and said casing; and a conveyor member disposed in said developer transport space and located upstream of a contact position where said developer carrier contacts said supply member and the developer is to be transferred from said supply member to said developer carrier with respect to an intended direction of movement of said supply member for conveying said developer in at least a longitudinal direction of said supply member to said developer transport space, said developer conveyed by said conveyor member being stored in said developer transport space such that substantially all of the developer is stored above said contact position.

* * * * *